US010611524B2

(12) United States Patent
Harvey

(10) Patent No.: US 10,611,524 B2
(45) Date of Patent: Apr. 7, 2020

(54) DIVIDER FOR RIGID CONTAINER

(71) Applicant: Eric Robert Harvey, Bend, OR (US)

(72) Inventor: Eric Robert Harvey, Bend, OR (US)

(73) Assignee: Mason-ry, Inc., Bend, OR (US)

( * ) Notice: Subject to any disclaimer, the term of this patent is extended or adjusted under 35 U.S.C. 154(b) by 3 days.

(21) Appl. No.: 15/867,957

(22) Filed: Jan. 11, 2018

(65) Prior Publication Data

US 2018/0201410 A1 Jul. 19, 2018

Related U.S. Application Data

(60) Provisional application No. 62/446,924, filed on Jan. 17, 2017.

(51) Int. Cl.

| | |
|---|---|
| ***B65D 25/08*** | (2006.01) |
| ***B65D 25/04*** | (2006.01) |
| ***B65D 25/10*** | (2006.01) |

(52) U.S. Cl.

CPC ..... *B65D 25/08* (2013.01); *B65D 25/04* (2013.01); *B65D 25/101* (2013.01)

(58) Field of Classification Search

CPC ..... B65F 1/00–1/062; B65F 2230/00–148

See application file for complete search history.

(56) References Cited

U.S. PATENT DOCUMENTS

| | | | | |
|---|---|---|---|---|
| 3,399,546 | A * | 9/1968 | Kuns | F25D 3/08 62/371 |
| 4,164,312 | A * | 8/1979 | Harned | B65D 5/48048 206/448 |
| 7,410,094 | B2 * | 8/2008 | Bos | B65D 5/48038 220/529 |
| 7,428,975 | B2 * | 9/2008 | Bradford | B65D 25/08 220/529 |
| 8,061,548 | B1 * | 11/2011 | Peggs | B65D 83/04 206/538 |
| 8,602,246 | B2 * | 12/2013 | Frohwein | B65D 75/58 220/530 |
| 8,657,142 | B2 * | 2/2014 | Wolfe | B65D 25/04 220/500 |
| 2004/0069788 | A1 * | 4/2004 | Johns | B65D 1/36 220/575 |
| 2005/0230273 | A1 * | 10/2005 | Kohler | B65D 71/0081 206/170 |
| 2010/0320105 | A1 * | 12/2010 | Aubery | A63B 55/00 206/315.7 |

* cited by examiner

*Primary Examiner* — Kareen K Thomas

(57) ABSTRACT

This invention is directed toward a divider for use in a rigid container. The divider having a main body with a two-fold or higher symmetry about a vertical axis, a number of tab sets that correspond in number to the degree of symmetry of said main body, wherein said tab sets are located at the furthest extent of said main body from said vertical axis; and wherein said tab sets and said main body are capable of flexing without plastic deformation during insertion of said divider into said rigid container whereby said tab sets provide a normal force against an interior surface of said rigid container.

7 Claims, 3 Drawing Sheets

DIVIDER FOR RIGID CONTAINER

BACKGROUND OF THE INVENTION

1. Technical Field

The present invention relates to dividing an area comprised by a container into smaller substantially segregated areas.

2. Prior Art

Efforts to divide containers into smaller segregated areas use either drop in solutions which easily fall out of the container or slide around in the container or have the dividing means built into the container itself which renders the container more expensive and does not allow a user to use the container as a container without divisions.

SUMMARY OF THE INVENTION

The present invention is a device for dividing an area comprised by a rigid container into a plurality of smaller areas that are substantially segregated from one another.

Other embodiments of the device further comprise a retaining tab.

Still other embodiments of the device have a plurality of legs exhibiting a trifold symmetry which when in use with a rigid container creates 3 areas that are substantially segregated from one another.

DETAILED DESCRIPTION OF THE INVENTION

Figure 1:
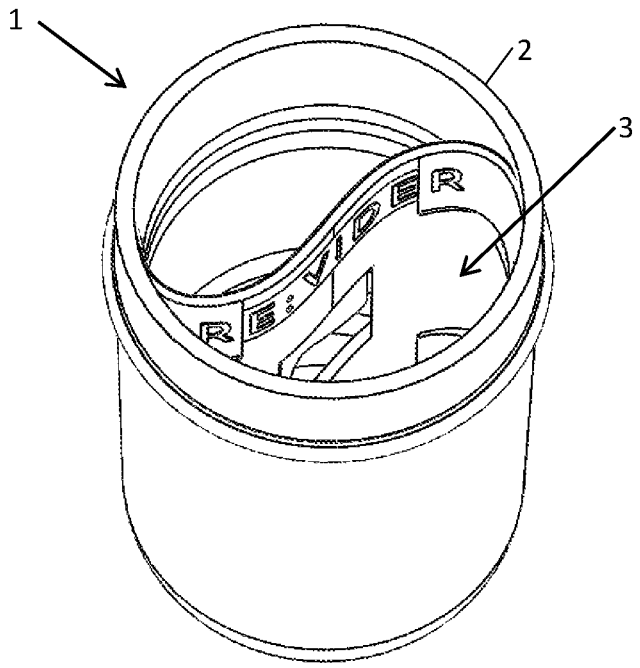
FIG. 1 illustrates a divider constructed according to aspects of the invention in use in a container.

FIG. 1 illustrates a divider system 1 which is comprised of a divider 3 constructed according to aspects of the invention and a container 2. Referring to the container 2 in more detail, the container 2 depicted in FIG. 1 is a rigid glass container. However, in alternative embodiments of the divider system 1 the container 2 may be constructed of any type of material that is substantially rigid such as silicone, metal or plastic. Substantially rigid is defined as being able to resist the outward force created by a divider 3 when inserted into the container 2 without deforming such that the force created by said divider 3 flexing the container 2 after insertion into the container 2 is insufficient to retain the divider in the container 3.

Figure 2:
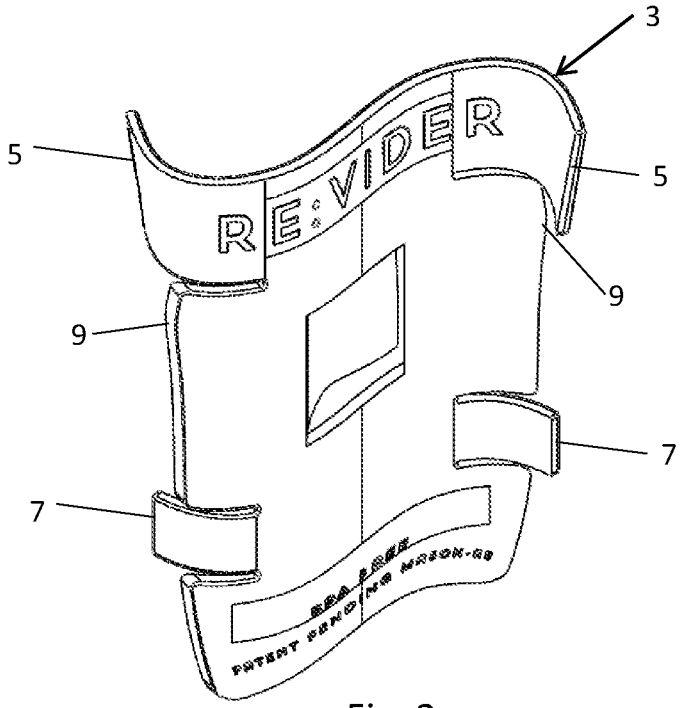
FIG. 2 illustrates a perspective view of a divider constructed according to aspects of the invention.

FIG. 2 illustrates a divider 3 constructed according to aspects of the invention. In this embodiment, the divider 3 comprises an upper tab 5, a lower tab 7, and a retaining bump 9. In the embodiment depicted in FIG. 2 the divider 3 has a two fold symmetry about the vertical axis. As such, there are two tab sets with a tab set defined, in this embodiment, as an upper tab 5 and lower tab 7 located vertically relative to one another. In other embodiments, such as a divider 3 with threefold symmetry there will be three tab sets. In still other embodiments, such as a divider with 4 fold symmetry there will be four tab sets, and so on.

Figure 3:
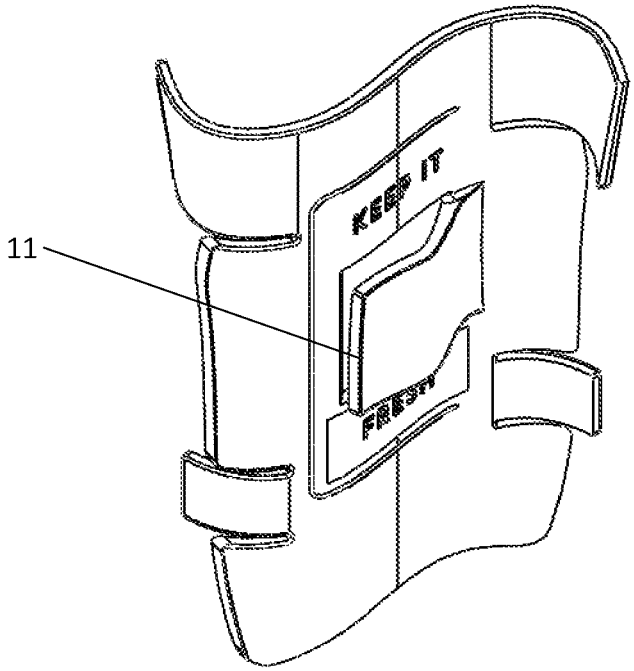
FIG. 3 illustrates a perspective view of a divider constructed according to aspects of the invention.
Figure 4:
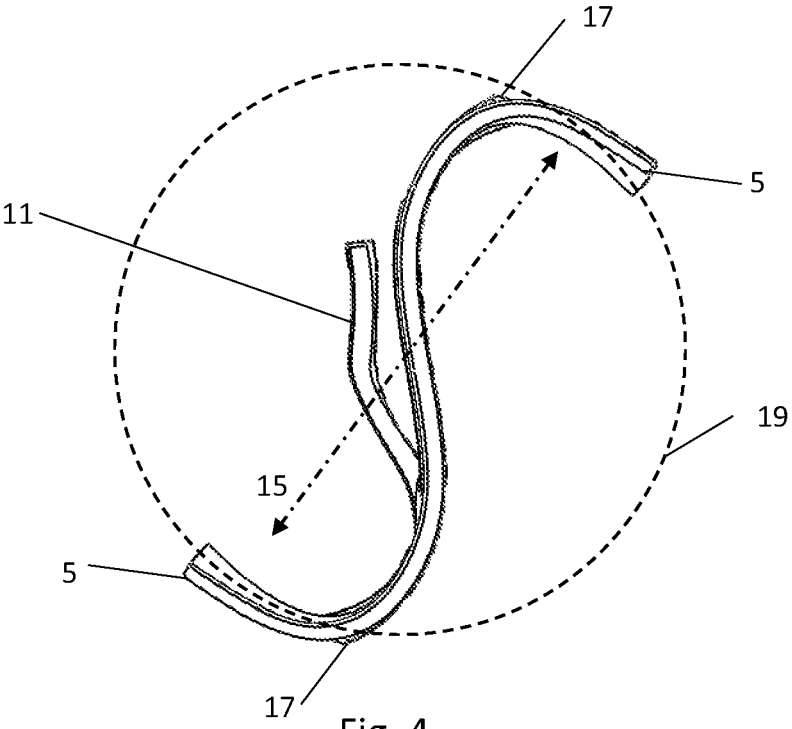
FIG. 4 illustrates a top view of a divider constructed according to aspects of the invention.

FIG. 3 illustrates a divider 3 constructed according to aspects of the invention. In this embodiment, in FIG. 3, a retaining tab 11 is indicated. FIG. 4 illustrates a top view of a divider 3 constructed according to aspects of the invention. In the embodiment depicted in FIG. 4 (the same as FIG. 3) a retaining tab 11 is visible extending from the surface of the divider 3 between the tab sets. The retaining tab 11 may not be present in all embodiments of the divider 3. In embodiments comprising the retaining tab 11, the retaining tab 11 is a portion of material which extends from a surface of the divider between tab sets and is suitable for retaining an item. Example items include humidity control packs, or tobacco rolling papers. The exact dimensions of the retaining tab 11 in height, width, thickness and total extent from the surface it originates from will vary according to the needs of an embodiment and particular material properties of the material the divider 3 is constructed from.

Referring to the material that the divider 3 is constructed from in more detail, the divider may be constructed out of any material that is sufficiently resilient to provide a suitable outward force when the divider 3 is compressed along the compression axis 15. (The axis is approximate as it will change during compression as the contact patch between the container and the divider changes). A divider 3 constructed according to aspects of the invention is retained within a container 2 due to friction created by a normal force created between the tab sets on the divider 3 and the interior surface of the container 2. Said normal force is created via the compression of the divider 3 during insertion into a container 2. It is clear then that the normal force, and thus retaining force, will be due to the mechanical properties of the divider 3. Materials which are suitable for use in constructing a divider 3 according to the invention taught herein include silicone, plastic, fiber filled plastics, metals, carbon fiber and other composite materials and other organic materials such as hardwoods and bamboo.

Figure 5:
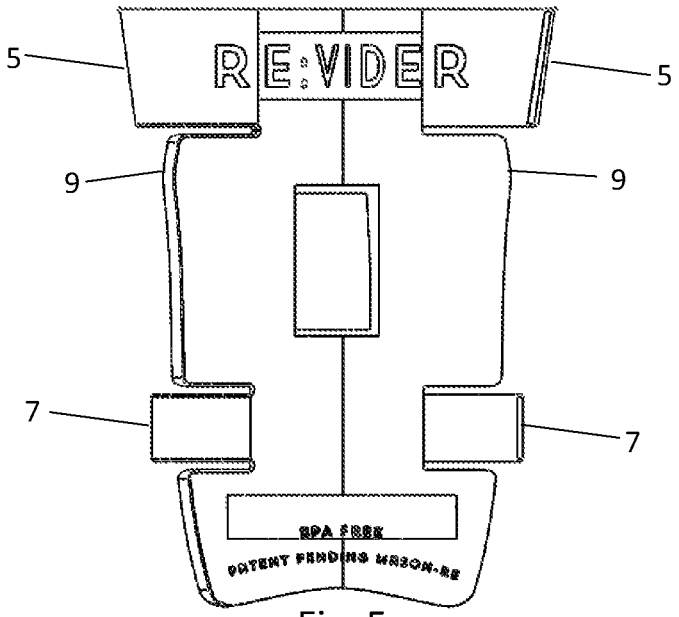
FIG. 5 illustrates a side view of an exemplary divider constructed according to aspects of the invention.
Figure 6:
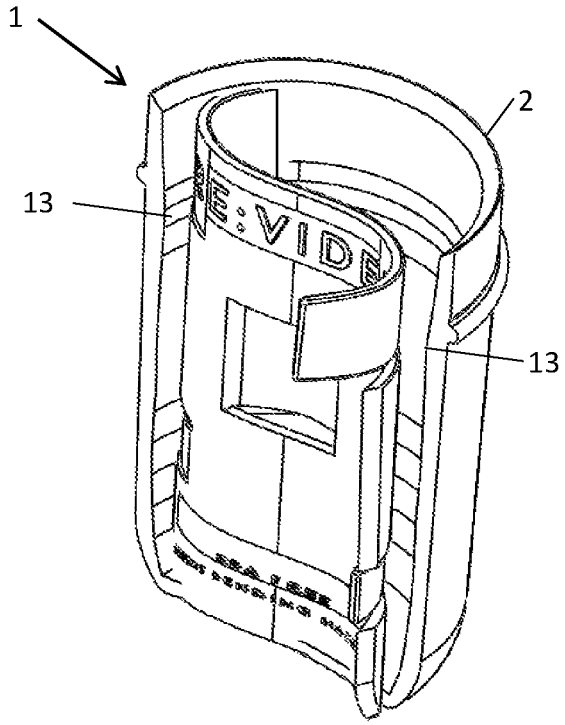
FIG. 6 illustrates a perspective view of a divider constructed according to aspects of the invention inside container shown in a section view.

FIG. 5 depicts a side view of a divider 3 constructed according to aspects of the invention. The upper tab 5 and lower tab 7 comprising the two tab sets (left side and right side of the FIG. 5) are visible. Also visible is the retaining bump 9. The retaining bump 9 is not present on all embodiments of the invention. FIG. 6 illustrates a divider system 1 with the container 2 depicted in a section view. In this divider system 1 embodiment the container 2 has a protrusion 13 under which the retaining bump 9 on the divider 3 is forced during insertion of the divider 3 into the container 2. In these embodiments the force of the protrusion 13 against the retaining bump 9 provides an additional force for retaining the divider 3 in the container. In certain embodiments the retaining bump 9 may not be present due to either a lack of protrusion 13 in the container 2 for which the divider 3 is designed for, or because the additional retention force is not necessary.

Referring to the design of the divider 3 in more detail, the divider 3 is constructed to have an exterior profile that follows the interior contours of the container 2 for which it is designed. For the embodiment depicted in FIG. 5, the exterior profile refers to the edges of the divider 3 located between the upper and lower tab 5 7 and the edge located around the divider between the lower tab 7 on opposite sides of the divider 3. In operation the exterior profile of the divider 3 would be located near or touching the interior profile of the container 2. The profile need not exactly match the inside of the container 2 and gaps of 0.1" or more are acceptable. However, the furthest extent of the upper and lower tabs 5, 7 relative to the center of the divider 3 will extend beyond the interior profile of the container 2 when the divider 3 is inserted into the container 2. As a result, when the divider 3 is pushed into the container 2, the tab sets engage the interior wall of the container 2 and provide an outward force against the container 2.

Referring to the upper tab 5 and lower tab 7 design in more detail, the upper tab 5 and lower tab 7 are designed so that they both extend beyond the exterior profile 17 of the divider 3. This is depicted in FIG. 4 where the top tab 5 is visible extending beyond the exterior profile 17 of the divider 3 and the interior of a hypothetical container 19. When inserted into a container 3 the tab sets are forced to flex inward and conform to the container 2. This force creates the normal force which helps retain the divider 3 in the container 2. The elliptical curve of the upper and lower tab 5 7 enables the material in the tab sets to flex without exceeding the mechanical properties of the divider 3 material. When elastomeric materials are used, the divider 3 may not require an elliptical curve. Instead, the tab sets may compress linearly in a direction normal to the interior surface of the container 2 and in plane with the divider. Additionally, in the embodiment depicted in FIG. 1-6 the two tab sets are comprised of tabs that curve in the same rotational direction, in other embodiments, different tab sets may be comprised of tabs that curve in opposite rotational directions. Still further, in embodiments with 3 or more tab sets, two or more tab sets may curve in the same rotational direction and one or more tab sets may curve in the opposite rotational direction.

Referring to the tab sets in more detail, the exact number of tabs per set is preferably greater than 1. In the embodiments depicted in FIGS. 1-6 each tab set is comprised of 2 tabs, an upper tab 5 and a lower 7. In other embodiments, there may be 3 or more tabs in each tab set. Additionally, in some embodiments, the entire edge of the divider 3 would be constructed as a tab so that each tab set would have 1 tab and the entire exterior edge of the divider 3 would flex to retain the divider in the container.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is a:

1. Divider for use in a rigid container comprising:

a main body with a two-fold or higher symmetry about a vertical axis;

a number of tab sets that correspond in number to a degree of symmetry of said main body, wherein said tab sets are located at a furthest extent of said main body from said vertical axis; and wherein said tab sets and said main body are capable of flexing without plastic deformation during insertion of said divider into said rigid container whereby said tab sets provide a normal force against an interior surface of said rigid container; and a retaining tab wherein said retaining tab extends from one surface of said main body and whereby said retaining tab is flexible for receiving and retaining an object.

2. The divider of claim 1 wherein said divider is constructed from a Silicone material.

3. The divider of claim 1 wherein said divider is constructed from a fiber filled thermoplastic material.

4. The divider of claim 1 wherein said main body has a 2 fold symmetry.

5. The divider of claim 1 wherein said main body has a 3 fold symmetry which results in said divider having 3 tab sets.

6. The divider of claim 4 wherein said tab sets are comprised of two tabs each.

7. The divider of claim 5 wherein each of three said tab sets are comprised of one tab wherein said one tab is coextensive with the edge of said main body.

* * * * *